United States Patent [19]

Schramm et al.

[11] 4,200,932

[45] Apr. 29, 1980

[54] MEANS FOR THE CONTROL AND REGULATION OF THE PRINTING PROCESS ON PRINTING PRESSES

[75] Inventors: Peter Schramm, Kahl am Main; Siegfried Schuhmann, Offenbach am Main; Edgar F. Schöneberger, Seligenstadt; Alfred Dorn; Bert Cappel, both of Mühlheim, all of Fed. Rep. of Germany

[73] Assignee: Roland Offsetmaschinenfabrik Faber & Schleicher AG., Fed. Rep. of Germany

[21] Appl. No.: 913,800

[22] Filed: Jun. 8, 1978

[30] Foreign Application Priority Data

Jun. 25, 1977 [DE] Fed. Rep. of Germany ..... 2728738

[51] Int. Cl.[2] ..... B41J 33/00

[52] U.S. Cl. ..... 364/519; 101/350; 364/400

[58] Field of Search ..... 364/519, 523; 101/365, 101/350, 426

[56] References Cited

U.S. PATENT DOCUMENTS

| | | | |
|---|---|---|---|
| 3,835,777 | 9/1974 | Krygeris | 101/350 |
| 4,091,911 | 5/1978 | Chang et al. | 364/519 |

*Primary Examiner*—Errol A. Krass

*Attorney, Agent, or Firm*—Leydig, Voit, Osann, Mayer & Holt, Ltd.

[57] ABSTRACT

An automatic ink feed control for a printing machine. Several ink-dosing elements are arranged across the width of the printing machine for dosing the application of ink to a printing plate, and these ink-dosing elements are individually adjustable by an adjusting device. The ink density of several control areas on the printed material is measured by a scanning measuring device, and a computer control compares these measured ink densities to desired ink densities in order to effect control of the adjustment of the ink-dosing elements by the adjusting device.

4 Claims, 4 Drawing Figures

MEANS FOR THE CONTROL AND REGULATION OF THE PRINTING PROCESS ON PRINTING PRESSES

The invention relates to means for controlling and regulating the printing process on printing presses, with means for dosing the application of ink to the printing plate, consisting of a number of ink-dosing elements arranged across the width and capable of being adjusted individually by means of an adjusting device, and with a density measuring device, by which a number of control areas on the printing material can be scanned, with each control area being associated a certain ink dosing element and each control area containing a plurality of control elements.

An essential cost factor in the printing process is the production of unusable prints as a consequence of incorrect ink or water application, especially during the adjusting of the press. But also during the consecutive regular printing process unusable prints are produced if certain parameters of the printing process change, for instance, if the rheological characteristics (= the flowing characteristics) of the ink change because of temperature rises.

Furthermore it is difficult for the operator of the printing press to compare a test sheet with the currently printed sheets properly over a longer period of time without additional means. It has, therefore, already early been attempted to automate not only the adjusting operation, but also the regular printing operation, by the use of measuring instruments, or at least to make possible an objective examination of the ink application. Thus, for instance, in the "Fogra-Mitteilung" No. 46 of September 1965, pages 2 to 5, an apparatus has been described through which the ink application of a sheet-fed printing press is to be regulated to a constant value that has once been fixed. This is accomplished by measuring the color density on a simultaneously printed reference mark. The apparatus consists of a photoelectric scanning device, a pulse transmitter for the generation of a control pulse, a control hookup for the processing of the measuring values, and an adjusting motor for influencing the inking system. However, the apparatus does not provide an independent regulation of the individual zone widths and is, therefore, not suited for the intended purpose.

Furthermore it is proposed by the *Deutsche Offenlegungsschrift* (= German Disclosure Specification) DT-OS 2 011 979 to scan by zones a measuring strip printed simultaneously with each revolution of the impression cylinder and to control the adjusting device for the setting screws of the individual zones in accordance with the results of a comparison of the actual values with the desired values. The control commands required for adjusting the setting screws of the individual zones are to be taken directly from a reference circuit and are to be transmitted to the adjusting device for the zone screws. The scanning is to take place during the operation of the press by moving the scanning device in the rhythm of the cylinder revolutions from zone to zone.

It has, however, proved technically unfeasible to scan at sheet as a whole over the full width by zones during the printing process. A scanning of several consecutive sheets by zones, however, leads to a falsification of the measuring results and thus of the regulation functions, especially when after the measuring of the actual value of the respective zone the corresponding resetting of the respective ink-dosing element takes place.

It is, therefore, the object of the invention to find a way to adjust all ink-dosing elements according to the results of the densitometric scanning of a single sheet by zones and to perform the regulating cycle in a reasonable time.

This problem is solved, in accordance with the invention, as described in the characterizing part of the following:

Means for the control and regulation of the printing process on printing presses, with an arrangement for dosing the ink application to the printing plate, consisting of a number of ink-dosing elements arranged over the width, which can be individually adjusted as desired via an adjustment device, and with a density measuring device, by which a number of control fields on the printing material can be scanned, with each control field being associated a certain ink-dosing element and each control field containing a plurality of control elements, characterized in that there is associated with the control and regulating means a compound system (25) of microcomputers (28, 29, 30, 31), into which programs for the control of the manner in which the control and regulating cycle takes place, for the computation of the position of the ink-dosing elements (6, 7, 8, 9), for the control of the density measuring device (24), and for the control of the ink-dosing elements have been stored.

In this manner a regulation of ink application which is independent of the printing speed and which can nevertheless be performed in a reasonable time is possible.

In a particular development of the invention the measuring, recording and controlling functions, which require great expenditure of time, are divided among the individual computers, so that in spite of the scanning of the sheets outside of the printing press advantageous regulation times for the ink application are nevertheless possible in the end. This, however, is of considerable importance since the printing of unusable sheets during the time before the regulation of ink application becomes effective will cause substantial costs.

In accordance with the invention, the necessary variations in the position of the dosing elements are computed by a central microcomputer from the measured density values and from preset density values fed into the computer on the basis of a suitable algorithm (= computing procedure). The algorithm may be modified in such a manner that in the computation of the positioning of the dosing elements the influence on the adjoining dosing elements, and/or from them, will be taken into consideration.

By providing a throw-over switch for optionally actuating the individual ink-dosing elements automatically or by hand it has been made possible to preset the dosing elements in accordance with the image to be printed. In contrast to already known presetting devices for ink-dosing elements the presetting in the present case is a genuine one. According to a practice that has long been employed, this presetting is performed by the pressman by estimation or on the basis of measurements on trial sheets or from empiric values obtained by a previous job. An only approximate estimation is possible because this presetting constitutes only the starting point for the regulation operation proper, which will then lead to the exactly correct setting values, that are independent from any parameters. This possibility of presetting the ink-dosing elements thus differs in a considerably advantageous manner from the method described in U.S. Pat. No. 3,185,088, according to which this presetting is actually a final setting, which has been obtained from a photoelectric scanning of the printing plate. By such a scanning of the printing portions of the printing plate or the film, however, the parameters such as paper, color and printing press adjustment data are by no means taken care of. In the last effect, the setting of the printing press is thus no longer possible, but must, on the contrary, just begin.

Brief Description of the Drawings

An exemplary embodiment of the invention will be described in the following in conjunction with the accompanying drawings. In these

Figure 1:
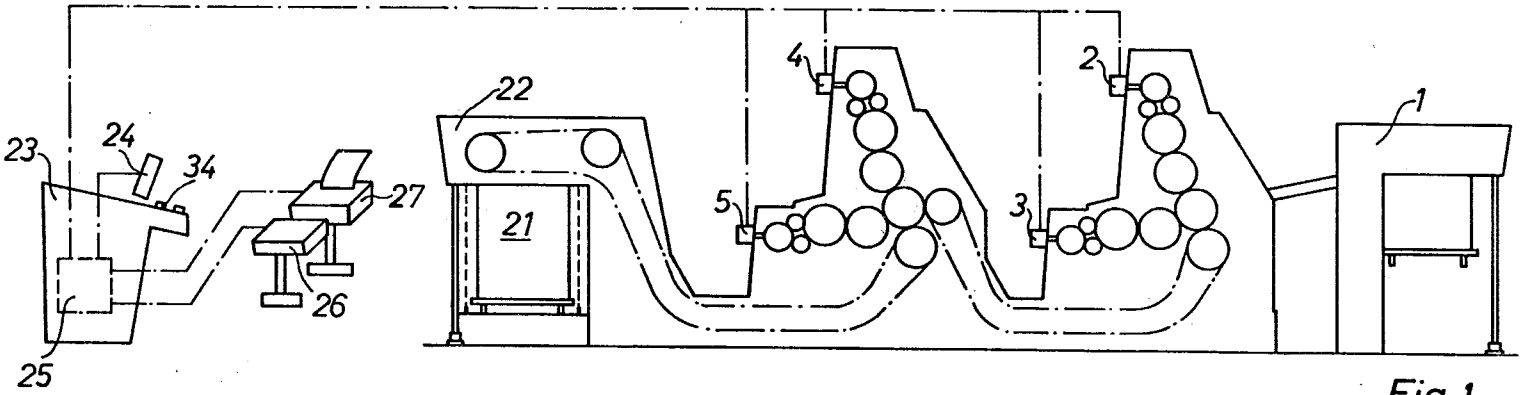
FIG. 1 shows schematically the arrangement of such apparatus in a four-color printing press.
Figure 2:
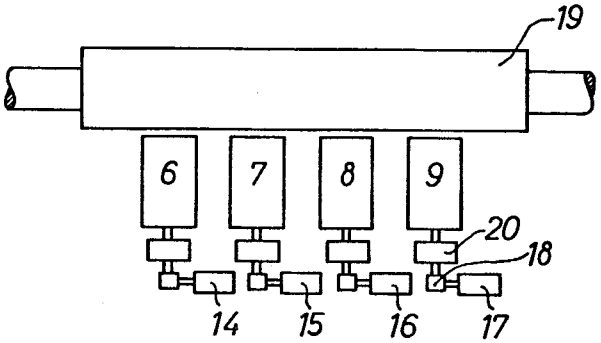
FIG. 2 shows schematically the arrangement for dosing the ink application.
Figure 4:
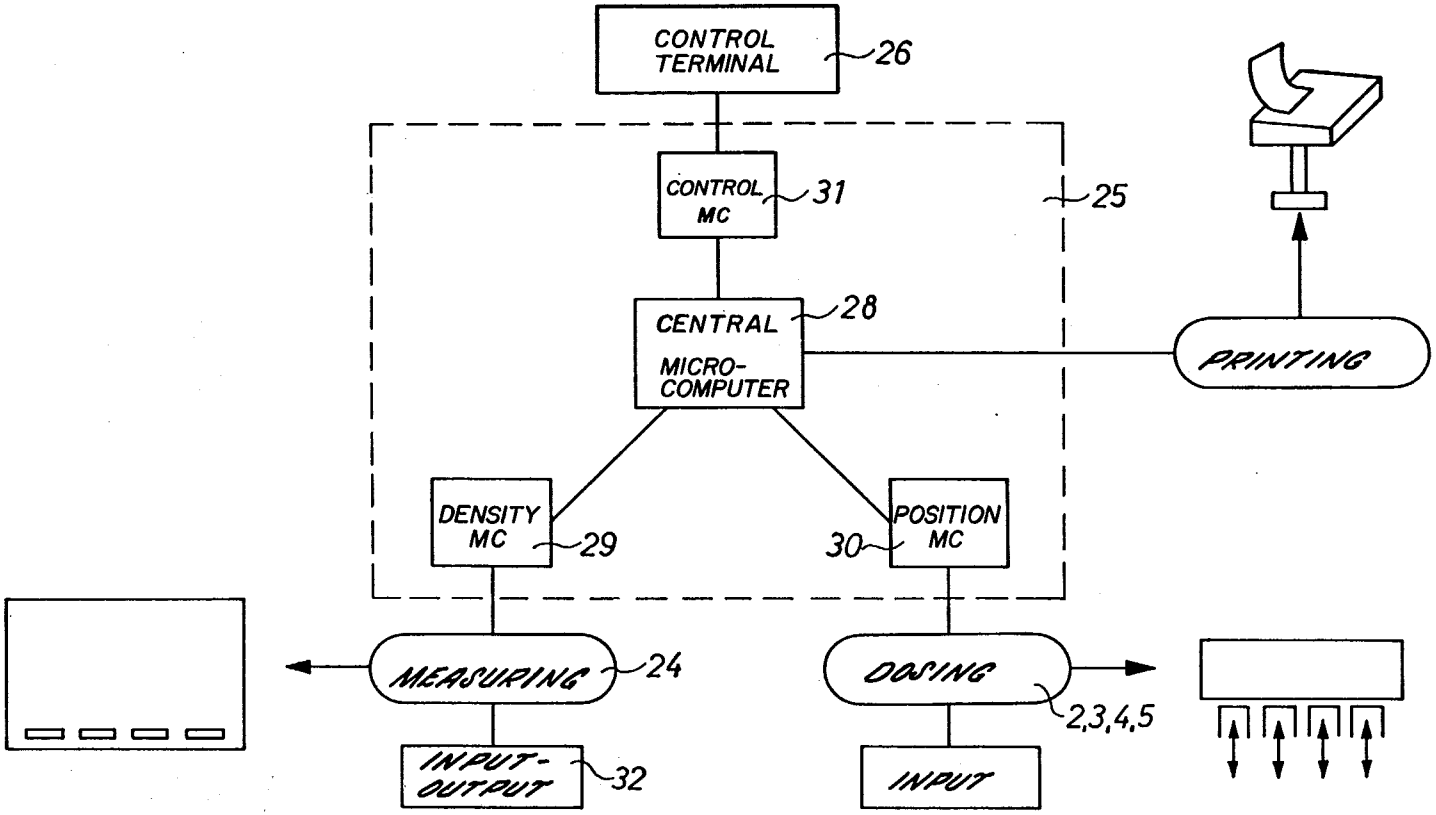
FIG. 4 shows a functional diagram of the arrangement.

The printing press according to FIG. 1 prints the sheets coming from the feeder 1 in a four-color printing operation, that is to say, it contains four printing units with the respective ink-dosing devices 2, 3, 4, 5. Each ink-dosing device consists, according to FIG. 2, of a plurality of ink-dosing elements 6, 7, 8, 9 disposed over the width, to which there are correspondingly associated, according to FIG. 3, control fields 10, 11, 12, 13 on the printed sheet. The ink-dosing elements are moved by adjusting motors 14, 15, 16, 17 via suitable transmissions 18 in the direction towards a roller 19 carrying the ink to the printing unit. In this manner control of the dosing elements is possible. The position of the dosing elements can be transmitted by potentiometric position indicators (Weggeber) 20.

The printed sheets are deposited in the usual manner upon the pile 21 of a delivery 22 and can be taken from there and be put on the control table 23. Here the control fields 10, 11, 12, 13 of the sheet are scanned by a traversing density measuring device 24.

Figure 3:
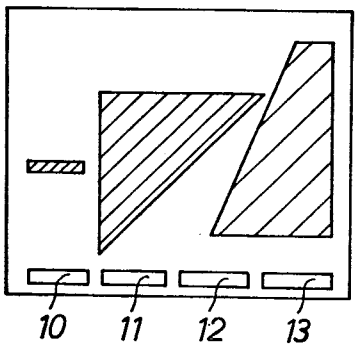
FIG. 3 shows a printed sheet with control fields.

Each control field 10, 11, 12, 13 according to FIG. 3 consists of several control elements, which are individually controlled by the color density measuring device 24 through a microcomputer 29. In the case of a four-color printing press each control field would, therefore, comprise four full-tone areas for measuring the color density. For the evaluation of the contrast, of doubling effects, etc., additional control elements may be introduced. The microcomputer 29, which controls the color density measuring device 24, must be accordingly programmed. The control fields 10, 11, 12, 13 are provided along the sheet edge at the beginning or the end of the image. The basic idea with this arrangement is that the reaching of a predetermined density in the control element will also ensure the correct ink application and/or color adjustment in the entire circumferential range of the respective color zone.

The compound system 25 of microcomputers is accommodated under the control table 23. It is connected, as can be seen from FIG. 1, with the color density measuring device 24, the ink-dosing devices 2, 3, 4, 5, a control unit 26 (terminal), and a printing device 27.

The compound system 25 consists of four microcomputers: a central microcomputer 28 takes over the organization of the regulating cycle, the control of the communication between operator and computer, the computation of the position of the ink-dosing elements, and the delivery of the protocol via the printing device 27. The microcomputer 29 controls the color density measuring device 24 and passes the measured density values to the central microcomputer 28. The microcomputer 30 receives the signals indicating the position of the ink-dosing elements and adjusts the dosing elements to a certain desired value. The microcomputer 31 identifies the individual key actuations at the control unit 26 and transmits these to the central microcomputer 28, which by actuation of various light-signal lamps on the control unit controls the sequence of the feeding steps. The color density measuring device 24 has an additional input and output device 32; the ink-dosing device has an additional input device for hand actuation with a pertinent throw-over switch 34.

The sequence of the individual steps of the control and regulation is as follows:

I. The control fields 10, 11, 12, 13 are measured with the density measuring device 24.

II. After density data have been transmitted to the central microcomputer 28, the central microcomputer 28 transmits to the microcomputer 30 the command to determine the position of the ink-dosing elements. The microcomputer 30 transmits these data. Now the central microcomputer 28 has the entire information that it needs for computing the new position of the ink-dosing elements. This new position is transmitted to the microcomputer 30. The microcomputer computes from the maximum difference between the old and the new position the time for adjusting the ink-dosing elements and performs the adjustment. After the adjustment the microcomputer ascertains the new position of the ink-dosing elements and transmits it to the central microcomputer. The central microcomputer compares the desired position of the ink-dosing elements with their actual position and emits, if the difference "desired position minus actual position" exceeds a certain measure, a warning signal.

III. Subsequently the central microcomputer 28 produces a protocol in which all important data of the performed regulation are recorded, namely:

a. position of the ink-dosing elements;

b. the desired density;

c. the actual density; and d. the desired density as well as the actual density as a graph.

The desired density can be defined. There are three alternatives:

a. The desired density is defined by the system itself; the value of the desired density depends upon the respective color (for example, black 1.5);

b. the desired density can be measured from a sheet (for instance, from the harmonization sheet);

c. the desired density may be freely defined as a numeric value on the console.

For the running of reorder jobs there is the possibility available of producing a perforated strip in which all information that is revelant for the printing job is stored. When this perforated strip is read off during the running of the reorder job, the system will adjust automatically the ink-dosing elements to the proper position.

We claim:

1. An ink feed control for a printing machine comprising:

means for dosing the ink feed to a printing plate of the printing machine including a plurality of ink dosing elements disposed generally laterally relative to the direction of movement of material being printed;

controlled adjustment means for individually adjusting the positions of the ink dosing elements and for producing current position values for the elements;

an ink density measuring device remote from the printing machine operable to scan a plurality of control fields on the printed material after a printing operation, the control fields being disposed generally laterally relative to the direction of movement of material being printed, to produce actual density values for the control fields;

comparator means for comparing the actual ink density values with desired ink density values;

first microcomputer means for controlling the scanning of the ink density measuring device and for collecting the actual density values from the ink density measuring device and coupling said actual values to the comparator means, the comparator means further including means for calculating position adjusting values for the ink dosing elements based upon current position values of the ink dosing elements and upon the comparisons of actual ink density values with desired ink density values; and second microcomputer means, receiving the position adjusting values from the comparator means, for controlling the adjustment means and for coupling the subsequent current position values of the ink dosing elements from the adjustment means to the comparator means, the comparator means further including means for relating the current position values with the position adjusting values to indicate nonconformities.

2. The control of claim 1 in which the delivery of a protocol is controlled by one of the comparator means, the first microcomputer means and the second microcomputer means.

3. The control of either of claims 2 or 1 in which the controlled adjustment means for the ink dosing elements can be changed over from automatic to manual adjustment by means of a throw-over switch.

4. The control of either of claims 2 or 1 which includes means for programming desired density values and data on the format, position and type of the control fields as well as the desired measuring and regulating program into the first and second computer means.

* * * * *

REEXAMINATION CERTIFICATE (79th)

United States Patent [19]

Schramm et al.

[11] B1 4,200,932

[45] Certificate Issued Apr. 26, 1983

[54] MEANS FOR THE CONTROL AND REGULATON OF THE PRINTING PROCESS ON PRINTING PRESSES

[75] Inventors: Peter Schramm, Kahl am Main; Siegfried Schuhmann, Offenbach am Main; Edgar F Schöneberger, Seligenstadt, Alfred Dorn; Bert Cappel, both of Mühlheim, all of Fed. Rep. of Germany

[73] Assignee: Roland Offsetmaschinenfabrik Faber & Schleicher AG., Fed. Rep. of Germany

Reexamination Request

No. 90/000,157, Feb. 11, 1982

Reexamination Certificate for:

| | |
|---|---|
| Patent No.: | **4,200,932** |
| Issued: | **Apr. 29, 1980** |
| Appl. No.: | **913,800** |
| Filed: | **Jun. 8, 1978** |

[30] Foreign Application Priority Data

Jun. 25, 1977 [DE] Fed. Rep. of Germany ..... 2728738

[51] Int. Cl. [3] ..... B41J 33/00; B41F 31/02

[52] U.S. Cl. .... 364/519; 101/350; 101/365; 364/400

[58] Field of Search ... 364/519, 523; 101/350, 356, 365, 366

[56] References Cited

U.S. PATENT DOCUMENTS

| | | | |
|---|---|---|---|
| 2,672,601 | 3/1954 | Welby | 340/686 |
| 2,978,977 | 4/1961 | Eckers, Jr. et al. | 371/57 |
| 3,110,884 | 11/1963 | Scharf | 371/57 |
| 3,170,021 | 2/1965 | Bergson | 356/26 |
| 3,490,010 | 1/1970 | Bernard et al. | 340/686 |
| 3,567,923 | 3/1977 | Hutchison | 250/226 |
| 3,588,696 | 6/1971 | Solvay | 324/121 R |
| 3,774,536 | 11/1973 | Raymond et al. | 101/207 |
| 3,829,848 | 8/1974 | Eickelberg et al. | 364/471 |
| 3,835,777 | 9/1974 | Krygeris | 101/350 |
| 4,059,960 | 11/1977 | Osborne | 340/686 |

FOREIGN PATENT DOCUMENTS

| | | |
|---|---|---|
| 1176395 | 5/1965 | Fed. Rep. of Germany. |
| 2247351 | 3/1974 | Fed. Rep. of Germany. |
| 1372900 | 11/1974 | United Kingdom. |
| 1474166 | 5/1977 | United Kingdom. |

OTHER PUBLICATIONS

ERA Lecture-Gretag D61-Automatic Color Density Measuring Device for Photogravure Printing, Published 1972 at Drupa.

Heidelberg Offset CPC Brochure, Published at Drupa, Jun. 3–16, 1977.

German Published Non-Prosecuted Application 2,141,355, 2/24/72.

German Published Non-Prosecuted Application 2,632,017, 2/23/77.

German Published Non-Prosecuted Application 2,011,979, 4/13/72.

Dutch Publication 1st nieuws 30. 1977.

German Published Non-Prosecuted Application 2,023,467, 11/25/71.

Fogra Mitteilungen No. 62, Sep. 1969.

Der Polygraph (Printamat Article) 4/20/77.

Gretah Lesture, Published at Drupa 1972.

Macbeth Brochure, Published at Drupa Jun. 3 to 16, 1977.

Der Polygraph (Mavo Article) 11/20/75.

Deutscher Drucker No. 19–20/May 24, 1977, pp. 166 and 170–172; Technical Advances in Offset Printing Regulated Ink Control By the New "Ruland-CCI-System".

*Primary Examiner*—Errol A. Krass

[57] ABSTRACT

An automatic ink feed control for a printing machine. Several ink-dosing elements are arranged across the width of the printing machine for dosing the application of ink to a printing plate, and these ink-dosing elements are individually adjustable by an adjusting device. The ink density of several control areas on the printed material is measured by a scanning measuring device, and a computer control compares these measured ink densities to desired ink densities in order to effect control of the adjustment of the ink-dosing elements by the adjusting device.

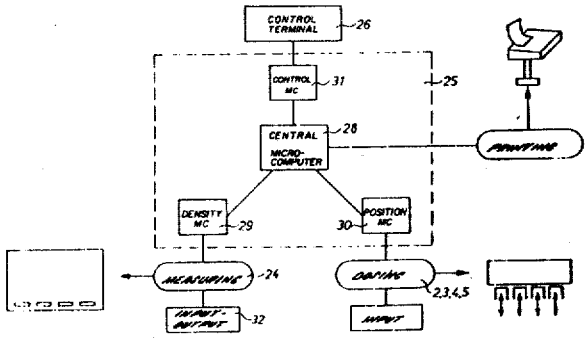

REEXAMINATION CERTIFICATE ISSUED UNDER 35 U.S.C. 307.

NO AMENDMENTS HAVE BEEN MADE TO THE PATENT.

AS A RESULT OF REEXAMINATION, IT HAS BEEN DETERMINED THAT:

The patentability of claims 1–4 is confirmed.

* * * * *